United States Patent [19]

Steiner

[11] Patent Number: 4,474,191

[45] Date of Patent: Oct. 2, 1984

[54] TAR-FREE SMOKING DEVICES

[76] Inventor: Pierre G. Steiner, 417 Sea Ridge Dr., La Jolla, Calif. 92037

[21] Appl. No.: 431,411

[22] Filed: Sep. 30, 1982

[51] Int. Cl.[3] ..... A24D 3/04

[52] U.S. Cl. ..... 131/198 A

[58] Field of Search ..... 131/329, 198 R, 336, 131/271, 198 A, 195, 196, 335

[56] References Cited

U.S. PATENT DOCUMENTS

| | | | |
|---|---|---|---|
| 2,104,266 | 1/1938 | McCormick | 131/329 |
| 2,580,974 | 1/1952 | Sutter | 131/329 |
| 2,667,170 | 1/1954 | Lebert | 131/195 |
| 3,258,015 | 6/1966 | Ellis et al. | 131/329 |
| 3,356,094 | 12/1967 | Ellis et al. | 131/329 |
| 3,496,946 | 2/1970 | Griffith | 131/329 |
| 3,516,417 | 6/1970 | Moses | 131/271 |
| 3,957,064 | 5/1976 | Mestre et al. | 131/329 |
| 4,141,369 | 2/1979 | Burruss | 131/329 |
| 4,188,958 | 2/1980 | Whitford | 131/329 |
| 4,210,160 | 7/1980 | Wunsche | 131/329 |
| 4,303,083 | 12/1981 | Burruss, Jr. | 131/329 |

FOREIGN PATENT DOCUMENTS

| | | | |
|---|---|---|---|
| 1113979 | 5/1968 | United Kingdom . | |
| 2064296 | 5/1981 | United Kingdom | 131/335 |

*Primary Examiner*—Vincent Millin

*Attorney, Agent, or Firm*—Robbins & Laramie

[57] ABSTRACT

Disposable smoking devices disclosed in a variety of pipe, cigarette or cigar configurations, and designed to totally suppress the inhalation by the user of the toxic substances contained in tobacco smoke. This goal is achieved by keeping the air-intake channel separated from the combustion chamber by a fire-resistant, but heat-conductive wall and by depositing on the channel-side of this wall nicotine and other tobacco-simulating substances in a volatile or sublimable form whose vapors only are inhaled; thus giving the user the same sensations as a common pipe, cigar or cigarette, but free of the deleterious effects inherent to the absorption of tobacco smoke.

The air intake channel may be located either in the center of the combustion chamber or along its periphery.

25 Claims, 13 Drawing Figures

FIG. 2
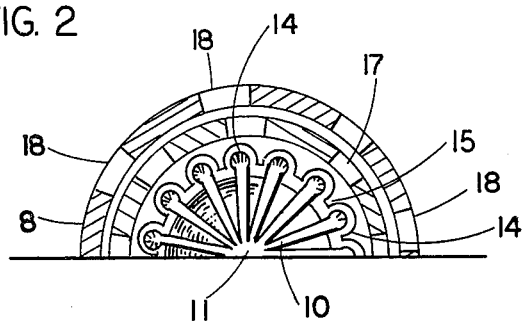
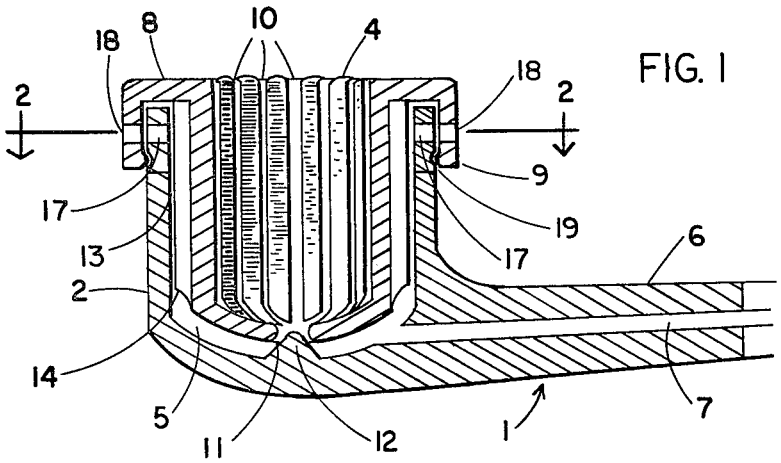
FIG. 1
FIG. 4
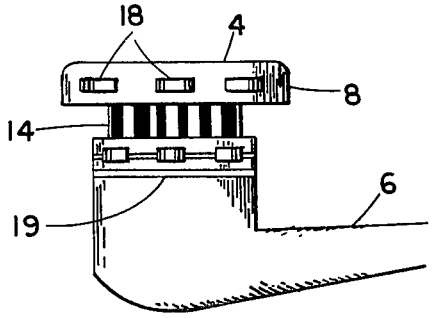
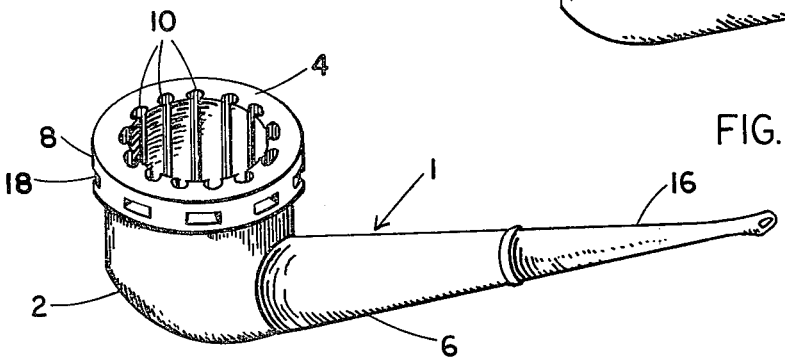
FIG. 3

TAR-FREE SMOKING DEVICES

FIELD OF THE INVENTION

The instant invention relates to pipes, cigarettes, cigars and other smoking devices. More specifically it relates to tobacco substitutes and to smoke-to-air ratio controlling apparatuses.

BACKGROUND OF THE INVENTION

A parallel is often drawn between the consumption of alcohol and the smoking of tobacco to the effect that both habits are injurious to health and have cummulative toxic effects. There is, however, a significant difference between the two practices in that one is not required when imbibing alcohol to absorb at the same time additional harmful substances; while the tobacco smoker, in addition to the euphoric and sedative nicotine, must inhale a multiplicity of parasitic compounds which are highly toxic and totally devoid of any enjoyable physiological properties.

As early as 1964 the Report of the Advisory Committee to the Surgeon General of the Public Health Service published by the U.S. Department of Health, Education, and Welfare stated at page 62 that "seven polycyclic compounds isolated from cigarette smoke have been established to be carcinogenic . . . The over-all carcinogenic potency of tobacco tar is many times the effects which can be attributed to substances isolated from it. The difference may be associated in part with the presence in tobacco smoke of cocarcinogens, several of which have been identified as smoke components." At page 145 the report further states that "one hypothesis suggests that promoting agents present in tobacco and tobacco smoke, such as various phenols, enhance the potency of the carcinogenic hydro-carbons so as to account for the biological activity of the tobacco products. Further, possible synergism between low levels of the several non-carcinogens in the tobacco condensates and extracts may also enhance the carcinogenic potency." The report goes on inventorying other noxious products found in tobacco smoke such as pesticides used in the husbandry of tobacco in the United States, lactones and radioactive components. In an article published in the Los Angeles Herald Examiner of July 29, 1982, it is reported that the one-and-one-half pack-a-day smoker receives a yearly dose of alpha-radiation equivalent to 300 chest X-rays—a dose to the windpipe area of some eight rems of radiation per year. By contrast, the government standard for total body radiation exposure for nuclear power plant workers is only 5 rems per year.

On the other hand, the HEW report states at page 74 that "the effects of nicotine at dosage levels absorbed from smoking (1–2 milligrams per inhaled cigarette) are comparatively small."

Countless attempts have been made over the last few years to reduce the tar content of smoking tobacco. Cigarette manufacturers commonly use comparative advertising showing the low-tar content of their product relative to others. By judicious use of filters and other techniques, the tar content of certain cigarettes has been reduced down to the relatively low level of one milligram. Unfortunately, these techniques tend also to reduce the amount of nicotine down to approximately 1 milligram per cigarette; forcing the smoker to use more than one cigarette or to take a deeper breath and hold it longer in the lungs in order to achieve the same effect as the one obtained from an unfiltered cigarette. In other words, no one has found a way to completely eliminate the poison-loaded smoke inhalation inherent to the consumption of tobacco without reducing or even eliminating at the same time the pleasing sensations derived from a good smoke which are mainly attributable to the nicotine intake. To make matters worse, the filtering process tends to remove the largest but least harmful particles, while letting pass through the smaller ones which because of their size tend to penetrate more deeply into the lung cells. Thus, we must face the paradox of an increase in the toxicity of cigarettes in proportion to the efficiency of the filtering process.

A new approach beyond the use of filters must be sought for making cigarette smoking safer but nevertheless enjoyable.

Another unpleasant characteristic of smoking pertains to the air polluting effect and more specifically the inhalation of tobacco smoke by persons who find themselves in close proximity to the smoker in a confined environment. The side effect upon the non-smoker has been observed particularly amongst bartenders and waitresses who work long hours in poorly ventilated bars and coffee houses. This problem has been only partially palliated by means of mechanical and electrostatic fan-driven filtering machines.

There have been some attempts to circumvent the deleterious effects of tobacco smoke by electronically heating the pipe bowl to a degree sufficient to volatize the nicotine and aromatic compounds held by the tobacco without inducing combustion. U.S. Pat. Nos. 2,104,266 McCORMICK and 4,141,369 BURRESS disclose prime examples of this approach.

U.S. Pat. No. 4,303,083 BURRESS, Jr. suggests the use of a similar method for administrating volatile medications.

The contrivances can only be used in the proximity of an electrical power source. They are cumbersome to use. They look, handle and operate in ways far different from the common smoking instrument to act as acceptable substitutes.

SUMMARY OF THE INVENTION

The present invention provides a means for completely eliminating the noxious inhalation of tar and other poison-carrying smoke by limiting the smokers intake to purified nicotine, tobacco-simulating aromatics and antidotal metabolites.

These substances are deposited in a volatile or sublimable form in the air-intake channel of a smoking device. This channel is completely isolated from the combustion chamber by a fire-resistant but heat-conductive wall. The smoke from the combustion chamber is not allowed to enter this air-intake channel. The combustion itself is used only to provide the heat necessary to the volatilization or sublimation of the substances.

Any concern for the nearby non-smoker can be eliminated by replacing the tobacco by a pleasant-smelling aerated cellulose-based combustible material.

Smoking devices according to this invention may be implemented in various configurations. The air-intake channel can take the form of a chimney running through the center of a pipe bowl, a cigar or a cigarette. In an alternate configuration the tobacco or substitute combustible material is held in a cupular chamber whose peripheral walls are surrounded by a series of channels converging toward the mouthpiece.

It is the principal object of this invention to provide a smoking device which completely eliminates the inhalation of tar and other poison-carrying smoke.

Another object of this invention is to provide such device with the appearance, taste and feel of the common pipe, cigarette or cigar, and to preserve all the enjoyable, physiological effects due to the intake of nicotine.

It is also an object of this invention to provide a means for alleviating the discomfort suffered by non-smokers who find themselves in close proximity to a smoking individual in a confined environment.

A further object of this invention is to improve the quality of the substances inhaled by the smoker by combining antidotal elements to the combination of purified nicotine and safe tobacco-simulating aromatics.

These and other objects are achieved by means of either one of the various devices disclosed below.

BRIEF DESCRIPTION OF THE DRAWINGS

FIG. 1 is a longitudinal cross-sectional view of a smoking pipe constructed in accordance with the invention;

FIG. 2 is a cross-sectional view taken along line 2—2 of FIG. 1;

FIG. 3 is a perspective view of the pipe;

FIG. 4 is a side view thereof showing the cupular insert partially pulled out;

DETAILED DESCRIPTION OF THE PREFERRED EMBODIMENTS OF THE INVENTION

Figure 5:
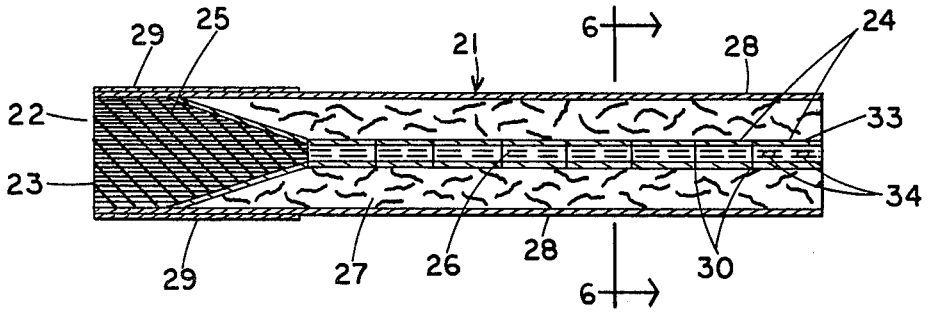
FIG. 5 is a longitudinal cross-sectional view of a cigarette or cigar constructed in accordance with the invention.

Referring now to the drawings and specifically to FIGS. 1 through 4, a first embodiment of the invention will be described. This first embodiment comprises a smoking pipe 1 whose head 2 receives a cupule-shaped insert 4. The insert is rimmed by an overlapping flange 8. A hole 11 at the bottom of the cupule 4 is closed by a nib 12 when the cupule is forced down toward the bottom of the pipe bowl 5. The level of the cupule 4 within the bowl 5 can be adjusted by threading the flange overlap 9 over the thread 19 appearing on the side of the pipe head 3. The overlap 9 has a series of peripheral holes 18 which match a similar series of holes 17 around the crown of the pipe head 9.

When the cupule 4 is fully engaged into the pipe bowl 5, the two sets of holes 17 and 18 are lined up. An air passage is created through these holes all the way to the mouth piece 16 via the interstice 13 between the exterior wall of the cupule 4 and the inside wall of the pipe bowl, and the stem conduit 7. When the position of the cupule 4 is raised by a counter-clockwise twisting movement within the pipe bowl 5, the hole 11 is opened but the series of crown holes 17 and 18 are no longer in line. The mouth piece 16 comes into communication with the inside of the cupule 4.

The cupule 4 is preferably made of ceramic material, zinc, carbon fiber alloy or any other material that can be pressed or molded to the desired shape and can withstand the burning temperature of tobacco or similar substances. The outside walls of the cupule are preferably made porous and are crenelated in order to facilitate heat dissipation within the interstice 13. The inside walls of the cupule 4 are striated with a series of vertical cylindrical furrows 10 converging down to the bottom hole 11. These furrows have lip openings which are very narrow and prevent the tobacco piece from penetrating therein. They are designed to aerate the contents of the cupule to facilitate combustion of the tobacco or substitute material. Volatile and sublimable substances which will vaporize when the cupule is heated are impregnated in the porous surface of the outside walls. These substances are chosen to smell, taste and act as would burning tobacco. They include nicotine, tobacco-smelling or tobacco-tasting aromatics and antidotal metabolites such as niacinamid. Those substances which tend to vaporize or sublimate at lower temperature are impregnated on the raised areas of the outside walls, while the less volatile components are preferably impregnated into the concave areas 15 between crenels.

The device is used as follows. The cupule 4 is raised to the upper position which opens hole 11, but closes the air path through holes 17 and 18. The inside of the cupule is filled with tobacco or another combustible material. The pipe is lit in the customary manner by having the user draw air through the tobacco or the like to activate the combustion. Once the pipe is lit, the cupule 4 is twisted clockwise to a lower position until the bottom hole 11 is closed and the air is allowed to flow through holes 17 and 18. The heat from the combustion vaporizes the tobacco-simulating substances and the nicotine which are inhaled by the user, producing the same pleasing sensations as would be derived from inhaling the tobacco smoke; but without exposing the user or his neighbor to the deleterious effects of tar and other by-products found in tobacco smoke.

The cupule 4 can also be adjusted to an intermediary position which would allow the user to draw a mixture of tobacco smoke and substance carrying air. It should be noted that this air will be heated to a temperature close to that of tobacco smoke through the heat conductive walls of the cupule 4.

Figure 6:
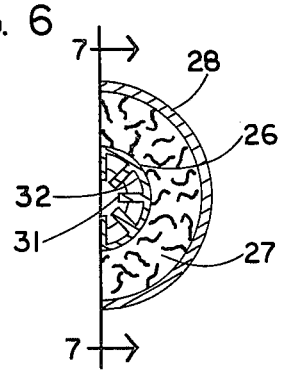
FIG. 6 is a cross-sectional view taken along line 6—6 of FIG. 5.
Figure 7:
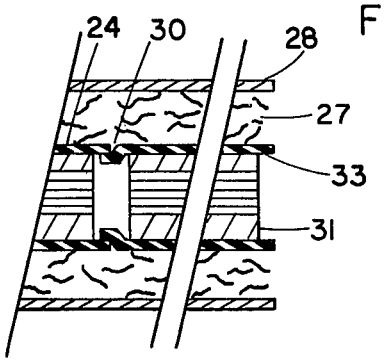
FIG. 7 is a partial cross-sectional view taken along line 7—7 of FIG. 6.

Referring now to FIGS. 5 through 7, a cigarette or cigar version of the invention will be described. The mouth piece 22 is composed like an ordinary cigarette of a short tubular element 23 designed to absorb saliva and avoid turbulences, and cork wrapper 29 applied above the layer of cigarette paper 28. The mouth piece 22 also includes a funnel 25 tapering down toward a chimney 26 which runs the length of the cigarette. Tobacco 27 or another combustible material is packed around the chimney 26 within the paper envelope 28. The chimney is made from a noncombustible material such as a ceramic, carbide of graphite alloy or any foil, and is broken down into several short sections 24 joined end-to-end and held by a bonding compound. This bonding compound may be a combustible or one such as a zinc oxide that will melt or become loose at the temperature of more than 400° centigrade. Each section has a plurality of internal fins 31 configured to provide a good dissipation into the chimney 26 of the heat generated by the tobacco combustion.

As in the previously described embodiment of the invention, volatile tobacco-simulating substances are applied to the inside of the chimney. The most volatile components are applied to the surface of the fins 31 and the least volatile ones are applied to the chimney walls in the space 32 between the fins. The end section 33 is provided with holes 34 which facilitate the lighting of the cigarette by allowing the smoker to draw tobacco smoke through the chimney 24. As the combustion progresses, each section of the chimney separates from the next one and falls off with the tobacco ashes. Except during the initial light phase, the smoker is not allowed to inhale the tobacco smoke but only the vapors emanating from the substances held in the chimney. Peroxide may be added to the tobacco or substitute material in order to facilitate combustion.

Figure 8:
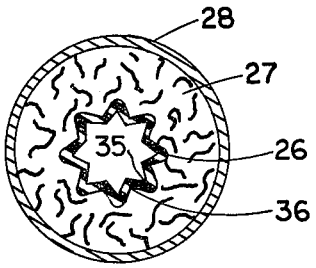
FIG. 8 is a transversal cross-sectional view of an alternate embodiment of the cigarette or cigar.

FIG. 8 shows an alternate configuration of the walls of the chimney 26. In this case the most volatile substances are deposited in the convex areas 36 of the inside wall of the chimney cup, while the least volatile one would be deposited in the concave areas 35 which are exposed to a higher temperature. The concave areas 36 on the outside wall of the chimney 26 act as furrows which bring air necessary to activate the combustion as in the previously described embodiment.

Figure 9:
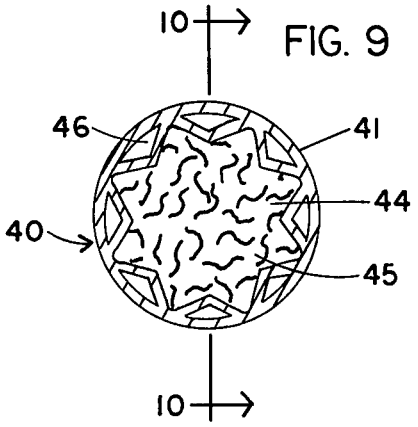
FIG. 9 is a transversal cross-sectional view of a second embodiment of a cigarette or cigar constructed according to the invention.
Figure 10:
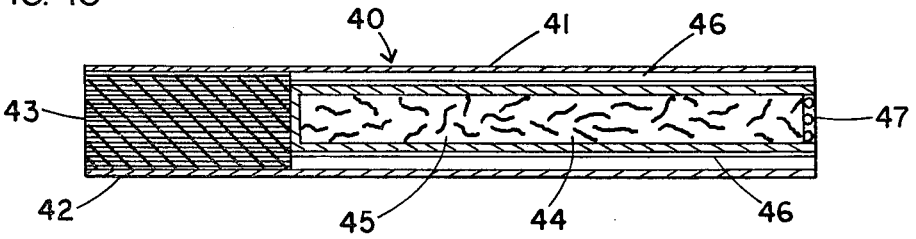
FIG. 10 is a longitudinal cross-sectional view taken along line 10—10 of FIG. 9.

FIGS. 9 and 10 disclose yet a third embodiment of the invention 40 which takes the appearance of a cigar or cigarette. This smoking device comprises a hard envelope made of ceramic or other noncombustible material. The tobacco 45 is compressed into a chamber 44 having walls in a star-like configuration, and mounted concentrically within the main envelope 41. The mouth piece 42 contains a tubular element to absorb saliva and avoid turbulences 43 and is in direct communication with the channels 46 which run between the outside envelope 41 and the combustion chamber 44. A small screen 47 is installed at the open end of the combustion chamber 44 to retain the tobacco and ashes therein.

As in the previously described embodiments of the invention, the tobacco-simulating substances are deposited within the channels 46. The most volatile substances are deposited against the inside walls of the external envelope 41, and the least volatile ones are deposited against the outside wall of the combustion chamber 44. A few holes in screen 47 are provided close to the burning end 49 of the cigarette in order to facilitate the lighting process. This embodiment of the invention has the added advantage of retaining the ashes therein and does not necessitate the use of an ashtray. The entire device can be discarded after use.

The cupular insert 4 of the first embodiment can also be of a disposable nature. The insert 4 can also be constructed with the cross-sectional configuration shown in FIG. 9 or in the alternative the crenelated exterior walls can be surrounded by a cylindrical envelope in order to protect the deposit of volatile substances.

Figure 11:
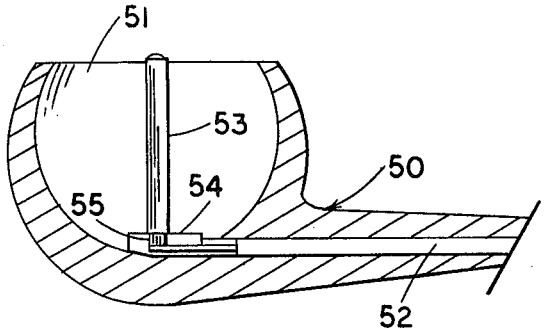
FIG. 11 is a longitudinal partial cross-sectional view of an alternate version of the smoking pipe.
Figure 12:
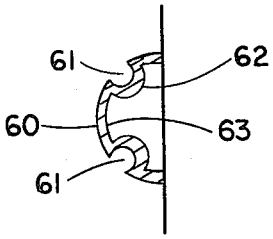
FIG. 12 is a transversal cross-sectional enlarged view of the air intake chimney taken along line 12—12 of FIG. 13.
Figure 13:
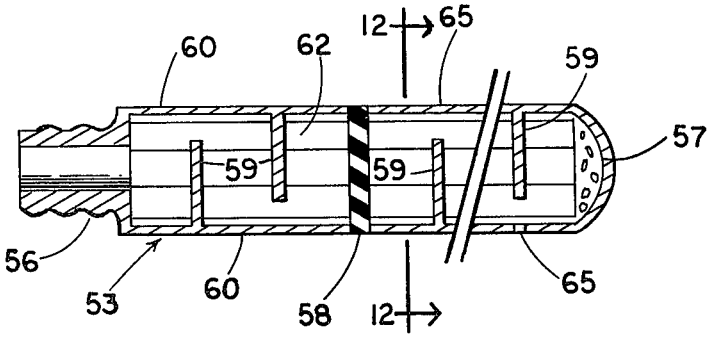
FIG. 13 is a longitudinal cross-sectional view of said air intake chimney.

Described in FIGS. 11 through 13 is yet a second embodiment 50 of a pipe according to the invention. At the bottom of the bowl 51 is a receptacle 54 engaged into the air conduit 52 of the pipe stem. This receptacle has an inside channel 55 with a threaded inlet facing upward. A tubular insert 53 provided with a threaded base 56 fits into the inlet of the receptacle 54. The tubular insert is made of heat conductive material and is broken down into several sections bonded end-to-end by a heat sensitive compound 58 similar to the one used in a previously-described embodiment of the invention. The tubular insert 53 is capped by a lid 57 having a plurality of air intake holes 64 drilled therethrough. A series of baffles 59 are interposed along the internal path of the tubular insert 53. The outside face of the wall 60 is furrowed longitudinally by a series of indentations 61 to the same intent and purpose as the furrows 10 found in the first-described embodiment of the invention. A few holes 65 are provided in the upper section of the insert to facilitate the initial lighting of the pipe. Nicotine and other volatile substances are deposited according to their volatility either against the raised area 62 of the inside wall or against the recessed area 63 which receive more heat from the combustion of tobacco or other material into the pipe bowl 51. The baffles 59 are designed to delay the propagation of heat within the columnar insert 53.

After the insert 53 has been installed into the receptacle 54, the bowl 51 can be filled with tobacco or other combustible material. The pipe is then lit and the insert operates in a manner similar to the one described in the embodiment shown in FIGS. 5 through 7.

All the above-described embodiments can be made to look like traditional smoking devices. They would also smell like them and give the same satisfactory sensations as may be obtained from the actual inhalation of tobacco smoke. These devices can be made in a reusable or disposable form. The suggested list of materials used in the construction of the heat transmitting components of these devices is not meant to be restrictive but could be expanded to include graphite, metals and metal alloys, ceramics, baked clays, or any other material having a melting point above the burning temperature of tobacco or its substitute material. It may be found convenient and economical to replace the tobacco with some purified cellulose-based product in an open-cell configuration, mixed with activated charcoal, which could be impregnated with the proper aromatic compounds in order to dispense a smoke-free, tobacco-like aroma.

While several embodiments of the invention have been disclosed and modifications thereof have been suggested, it should be understood that other embodiments and variations thereof may be devised without departing from the spirit of the invention and the scope of the appended claims.

What is claimed is:

1. A smoking device which comprises:

a combustion chamber;

combustible material held within said chamber;

a mouth piece;

an air-intake conduit connected to said mouth piece, said conduit having an area contiguous to said combustion chamber but separated from it by a heat-conductive wall, shaped and dimensioned to prevent smoke generated in said combustion chamber from entering said conduit and mouth piece means allowing temporary passage of air between the combustion chamber and the air intake conduit during the initial lighting of the smoker's device via an aperture shaped and positioned in said wall;

2. The device claimed in claim 1 wherein said volatile substances further comprise nicotine.

3. The device claimed in claim 2 wherein said volatile substances comprise aromatics.

4. The device claimed in claim 3 wherein said volatile substances comprise metabolite nicotine amide.

5. The device claimed in claim 1 wherein said area comprises first elements in close proximity with said combustion chamber, said first elements carrying the least volatile of said substances; and second elements more distal from said combustion chamber, said second elements carrying the most volatile of said substances.

6. The device claimed in claim 5 wherein said combustion chamber comprises an oblong envelope surrounding said material; and said air-intake conduit comprises a chimney running along said chamber.

7. The smoking device claimed in claim 6 wherein said chimney runs substantially in the center of said oblong envelope.

8. The smoking device claimed in claim 7 wherein said chimney is made of fire-resistant material.

9. The smoking device claimed in claim 8 wherein said chimney comprises a plurality of short sections joined together with a heat-sensitive bond.

10. The smoking device claimed in claim 9 wherein each section comprises heat absorbing areas projecting into said chamber; and heat-dissipating areas projecting into said conduit.

11. The smoking device claimed in claim 10 which further comprises a mouth piece; and a funnel-shaped element connecting said mouth piece to the inner end of said chimney.

12. The smoking device claimed in claim 7 wherein said chimney runs along the periphery of said chamber.

13. The smoking device claimed in claim 12 wherein said chimney comprises a plurality of channels.

14. The device claimed in claim 7 which further comprises a grid at the open end of said oblong envelope dimensioned to retain said material and its combustion residue therein.

15. The device claimed in claim 5 wherein said combustible material comprises a combination of purified open-cell cellulose foam and activated charcoal.

16. The device claimed in claim 1 wherein the combustion chamber side of said wall is furrowed by a plurality of grooves shaped and dimensioned to aerate said combustion chamber.

17. A smoking pipe comprising:

a bowl;

a mouth piece;

a stem connecting the bowl to the mouth piece;

said stem and said mouth piece having a channel therethrough in communication with the inside of said bowl;

a separable, heat-resistant cupule inserted within said bowl, said cupule suitable for holding combustible material and acting as a combustion chamber and wherein said cupule has at least an aperture shaped and positioned to allow temporary passage of air between the combustion chamber and said channel during the initial lighting of the smoking pipe;

means for drawing air around the periphery of said cupule and through said channel wherein said aperture is not in position to allow temporary passage of said air; and volatile substances applied against the outside walls of said cupule.

18. The pipe claimed in claim 16 which further comprises:

a protruding nib at the bottom of said bowl;

said cupule having a hole at the bottom in line with said nib; and means for moving the position of the cupule within the bowl from an upper level clear of said nib to a lower level wherein said nib closes said hole.

19. The pipe claimed in claim 17 wherein said cupule comprises a flanged rim overlapping the upper edge of the bowl.

20. The pipe claimed in claim 19 wherein said means for drawing air comprises:

said flanged rim having at least one peripheral aperture;

said bowl having at least one aperture under said flanged rim; and means for aligning said apertures with one another whereby air can be drawn between said bowl and said cupule.

21. The pipe claimed in claim 20 wherein the volatile substance carrying area comprises crenelated surfaces.

22. The pipe claimed in claim 21 wherein the most volatile of said substances are applied to the raised portion of said crenelated surfaces; and the least volatile substances are applied to the concave portion of said crenelated surfaces.

23. The pipe claimed in claim 22 wherein the inside walls of said cupule are furrowed by a plurality of vertical grooves converging toward said hole.

24. The pipe claimed in claim 20 wherein said means for moving comprises a threaded surface around the periphery of said bowl cooperating with a mating structure underneath said flanged rim.

25. The pipe claimed in claim 20 wherein said volatile substances comprise tobacco-simulating aromatics and nicotine.

* * * * *

UNITED STATES PATENT AND TRADEMARK OFFICE

CERTIFICATE OF CORRECTION

PATENT NO. : 4,474,191

DATED : October 2, 1984

INVENTOR(S) : Pierre G. Steiner

It is certified that error appears in the above-identified patent and that said Letters Patent is hereby corrected as shown below:

In column 6, claim 1, line 64, after "mouth piece", please insert --;-- and line 68, after "wall;" insert --and volatile substance held within said area.--

Signed and Sealed this

*Tenth* Day of *September 1985*

[SEAL]

*Attest:*

DONALD J. QUIGG

*Attesting Officer* *Acting Commissioner of Patents and Trademarks - Designate*